US006231752B1

(12) United States Patent
Putman

(10) Patent No.: US 6,231,752 B1
(45) Date of Patent: May 15, 2001

(54) PROCESS FOR THE REMOVAL OF MERCAPTANS

(75) Inventor: Hugh M. Putman, Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 0 days.

(21) Appl. No.: 09/398,373

(22) Filed: Sep. 17, 1999

(51) Int. Cl.[7] ..... C10G 45/00; C10G 45/02

(52) U.S. Cl. ..... 208/213; 208/208 R; 208/209; 208/210; 208/211; 208/217

(58) Field of Search ..... 208/208 R, 209, 208/210, 211, 213, 217

(56) References Cited

U.S. PATENT DOCUMENTS

| | | | |
|---|---|---|---|
| 5,321,163 | 6/1994 | Hickey et al. . | |
| 5,510,568 | 4/1996 | Hearn . | |
| 5,595,634 | 1/1997 | Hearn et al. . | |
| 5,597,476 | 1/1997 | Hearn et al. . | |
| 5,807,477 | 9/1998 | Hearn et al. . | |
| 5,863,419 * | 1/1999 | Huff, Jr. et al. | 208/237 |
| 6,090,270 * | 7/2000 | Gildert | 208/57 |

FOREIGN PATENT DOCUMENTS

WO 96/18704 6/1996 (WO) .

* cited by examiner

*Primary Examiner*—Walter D. Griffin
(74) *Attorney, Agent, or Firm*—Kenneth H. Johnson

(57) ABSTRACT

A process for treating a full boiling range naphtha is disclosed in which the mercaptans and diolefins are removed simultaneously in a debutanizer distillation column reactor. The mercaptans are reacted with the diolefins to form sulfides which are higher boiling than the $C_4$ and lighter portion of the naphtha which is taken as overheads. The higher boiling sulfides are removed as bottoms along with any $C_5$ and heavier materials. The bottoms are preferably taken to a splitter where a portion is taken as overheads and a heavier portion is recovered with the sulfides. This reduced volume of naphtha may be hydrogenated to convert the sulfides to $H_2S$ and diolefins, which may be hydrogenated to olefins and alkanes.

11 Claims, 1 Drawing Sheet

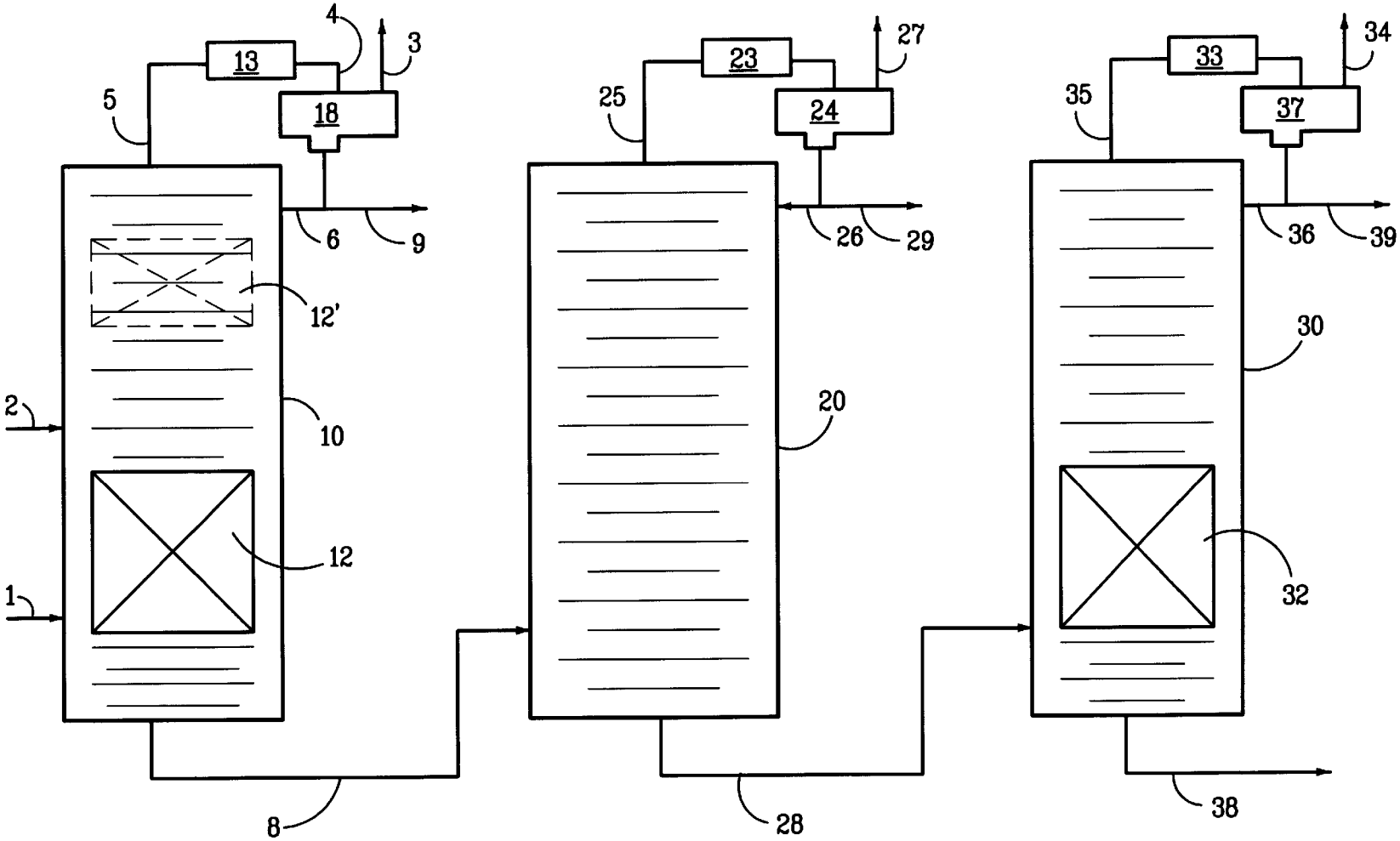
FIGURE

PROCESS FOR THE REMOVAL OF MERCAPTANS

BACKGROUND OF THE INVENTION

1. Field of the Invention

The present invention relates generally to a process for the removal of mercaptans from petroleum distillate streams. More particularly the invention relates to a process wherein the petroleum distillate contains diolefins which are selectively reacted with the mercaptans to form sulfides. Most particularly the invention relates to a process wherein the reaction of the mercaptans with the diolefins is carried out simultaneously with a fractional distillation to remove the sulfides, and thus the sulfur, from the distillate.

2. Related Information

Petroleum distillate streams contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and poly-unsaturated materials (diolefins). Additionally, these components may be any of the various isomers of the compounds.

The petroleum distillates often contain unwanted contaminants such as sulfur and nitrogen compounds. These contaminants often are catalyst poisons or produce undesirable products upon further processing. In particular, the sulfur compounds can be troublesome. The sulfur compounds are known catalyst poisons for naphtha reforming catalysts and hydrogenation catalysts. The sulfur compounds present in a stream are dependent upon the boiling range of the distillate. Mercaptans are most commonly found in the lower boiling range distillates such as the "front end" of a full boiling range naphtha.

The most common method of removal of the sulfur compounds is by hydrodesulfurization (HDS) in which the petroleum distillate is passed over a solid particulate catalyst comprising a hydrogenation metal supported on an alumina base. Additionally copious quantities of hydrogen are included in the feed. The following equations illustrate the reactions in a typical HDS unit:

$$RSH+H_2 \rightarrow RH+H_2S \quad (1)$$

$$RCl+H_2 \rightarrow RH+HCl \quad (2)$$

$$2RN+4H_2 \rightarrow RH+NH_3 \quad (3)$$

$$ROOH+2H_2 \rightarrow RH+H_2O \quad (4)$$

Typical operating conditions for the HDS reactions are:

| | |
|---|---|
| Temperature, ° F. | 600–780 |
| Pressure, psig | 600–3000 |
| $H_2$ recycle rate, SCF/bbl | 1500–3000 |
| Fresh $H_2$ makeup, SCF/bbl | 700–1000 |

As may be seen the emphasis has been upon hydrogenating the sulfur and other contaminating compounds. The sulfur is then removed in the form of gaseous $H_2S$, which in itself is a pollutant and requires further treatment.

The naphtha stream from either a crude distillation column or fluid catalytic cracking unit is generally fractionated several times to obtain useful cuts. The full boiling range naphtha ($C_4$–430° F.) may first be debutanized to remove $C_4$ and lighter materials as overheads in a debutanizer, then depentanized to remove $C_5$ and lighter materials as overheads in a depantanizer (sometimes referred to as a stabilizer) and finally split into a light naphtha (110–250° F.) and a heavy naphtha (250–430°).

U.S. Pat. No. 5,510,568 (Hearn) discloses a process for removing mercaptans from a distillate feed in a distillation column reactor by reacting the diolefins in the feed to form sulfides in the presence of a Group VIII metal catalyst and hydrogen. U.S. Pat. No. 5,321,163 (Hickey et al) discloses a similar process with an etherification zone also positioned in the distillation column reactor. In both of these processes the distillate feed is fed below the catalyst bed.

One advantage of the present invention is that the present process allows the use of existing debutanizers which are higher pressure than existing gasoline splitters thus providing the appropriate temperatures in the thioetherification bed not obtainable in the low pressure gasoline splitters. The complete gasoline stream through the end point is contacted with the thioetherification catalyst, thus the mercaptans throughout the gasoline range are reacted to heavier thioetherification. Other advantages and features of the present invention will become apparent from the following description.

SUMMARY OF THE INVENTION

The present invention presents an improved process for the removal of mercaptans from a full boiling range ($C_4$–430° F.) cracked naphtha stream. The cracked naphtha contains $C_4$'s to $C_8$'s components which may be saturated (alkanes), unsaturated (olefins) and poly-unsaturated (diolefins) along with minor amounts of the mercaptans. The full boiling range naphtha is debutanized in a fractional distillation column to remove that portion containing the $C_4$ and lower boiling materials ($C_4$−) as overheads and the $C_5$ and higher boiling materials ($C_5$+) as bottoms. The present invention utilizes the lower portion of the debutanizer to react substantially all of the mercaptans contained in the full boiling range cracked naphtha with a portion of the diolefins to form sulfides (thioethers). Any methyl mercaptan present would be in the $C_4$ fraction and may be reacted and removed in a small catalyst bed positioned above the naphtha feed. The sulfides (including any made in an upper bed) are removed as bottoms from the debutanizer column along with the $C_5$+ which is passed on to a depentanizer type distillation column where the sulfides are removed with the bottoms $C_6$+ (or $C_7$+) and a $C_5$ or ($C_5$/$C_6$) fraction having reduced sulfur is recovered overhead. The sulfides in the bottoms may be hydrogenated in a separate distillation column reactor or a non distillation fixed bed to cleave the sulfide thereby producing $H_2S$ and hydrogenating diolefins. The $H_2S$ separated therefrom is non-condensibles.

The catalyst used for the sulfide reaction is a supported Group VIII metal such as nickel sulfide, e.g., nickel/molybdenum on an alumina base which is conveniently configured as a catalytic distillation structure.

In the sulfide reaction, hydrogen is provided as necessary to support the reaction and to reduce the oxide and maintain it in the hydride state.

The present process preferably operates at overhead pressure of sulfide (first) distillation column reactor in the range between 50 and 200 psig and temperatures within said distillation reaction zone in the range of 100 to 400° F., preferably 130 to 270° F. The hydrogen partial pressure is between 0.01 and 30 psi. The conditions for this separation are fortuitously appropriate for the sulfide reaction. The pressure selected is that which maintains catalyst bed temperature between 100° F. and 400° F.

The term "reactive distillation" is sometimes also used to describe the concurrent reaction and fractionation in a column. For the purposes of the present invention, the term "catalytic distillation" includes reactive distillation and any other process of concurrent reaction and fractional distillation in a column regardless of the designation applied thereto.

BRIEF DESCRIPTION OF THE DRAWING

The FIGURE is a simplified flow diagram of one embodiment of the invention.

DESCRIPTION OF THE PREFERRED EMBODIMENTS

The present invention provides a process for the reaction of diolefins within a petroleum distillate with the mercaptans within the distillate to form sulfides and concurrent separation of the higher boiling sulfides with the heavier portion of the distillate. This requires a distillation column reactor which contains an appropriate catalyst, for example in the form of a catalytic distillation structure.

The feed to the present unit is contained in a single "full range naphtha" cut which may contain everything from $C_4$'s through $C_{12}$'s and higher. This mixture can easily contain 150 to 200 components. Mixed refinery streams often contain a broad spectrum of olefinic compounds. This is especially true of products from either catalytic cracking or thermal cracking processes. Refinery streams are usually separated by fractional distillation, and because they often contain compounds that are very close in boiling points, such separations are not precise. A $C_5$ stream, for instance, may contain $C_4$'s and up to $C_{12}$'s. These components may be saturated (alkanes), unsaturated (mono-olefins), or polyunsaturated (diolefins). Additionally, the components may be any or all of the various isomers of the individual compounds. Such streams typically contain 15 to 30 weight % of the isoamylenes.

Such refinery streams also contain small amounts of sulfur compounds which must be removed. The sulfur compounds are generally found in a cracked naphtha stream as mercaptans which poison the hydrogenation catalyst used to selectively hydrogenate diolefins. Removal of sulfur compounds is generally termed "sweetening" a stream.

Several of the minor components (diolefins) in the feed will react slowly with oxygen during storage to produce "gum" and other undesirable materials. However, these components also react very rapidly in the TAME process to form a yellow, foul smelling gummy material and consume acid in an alkylation unit. Thus, it is seen to be desirable to remove these components whether the "light naphtha" cut is to be used only for gasoline blending by itself or as feed to a TAME or alkylation process.

Catalysts which are useful in the mercaptan-diolefin reaction include the Group VIII metals. Generally the metals are deposited as the oxides on an alumina support. The supports are usually small diameter extrudates or spheres. The catalyst must then be prepared in the form of a catalytic distillation structure. The catalytic distillation structure must be able to function as catalyst and as mass transfer medium. The catalyst must be suitably supported and spaced within the column to act as a catalytic distillation structure. Suitably the catalyst is contained in a structure as disclosed in U.S. Pat. Nos. 5,730,843; 5,266,546; 4,731,229 and 5,073,236 which are incorporated by reference.

A suitable catalyst for the reaction is 58 wt % Ni on 8 to 14 mesh alumina spheres, supplied by Calcicat, designated as E-475-SR. Typical physical and chemical properties of the catalyst as provided by the manufacturer are as follows:

TABLE I

| | |
|---|---|
| Designation | E-475-SR |
| Form | Spheres |
| Nominal size | 8 × 14 Mesh |
| Ni wt % | 54 |
| Support | Alumina |

The hydrogen rate to the reactor must be sufficient to maintain the reaction, but kept below that which would cause flooding of the column which is understood to be the "effectuating amount of hydrogen" as that term is used herein. Generally the mole ratio of hydrogen to diolefins and acetylenes in the feed is at least 1.0 to 1.0, preferably at least 2.0 to 1.0 and more preferably at least 10 to 1.0.

The catalyst also catalyzes the selective hydrogenation of the polyolefins contained within the cracked naphtha and to a lesser degree the isomerization of some of the mono-olefins. Generally the relative rates of reaction for various compounds are in the order of from faster to slower:

(1) reaction of diolefins with mercaptans (2) hydrogenation of diolefins (3) isomerization of the mono-olefins (4) hydrogenation of the mono-olefins.

The reaction of interest is the reaction of the mercaptans with diolefins. In the presence of the catalyst the mercaptans will also react with mono-olefins. However, there is an excess of diolefins to mercaptans in the cracked naphtha feed and the mercaptans preferentially react with them before reacting with the mono-olefins. The equation of interest which describes the reaction is:

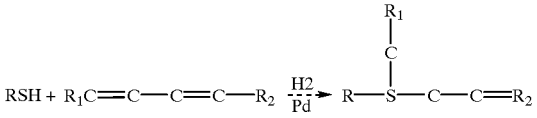

This may be compared to the HDS reaction which consumes hydrogen. The hydrogen consumed in the removal of the mercaptans in the present invention is that necessary to keep the catalyst in the reduced "hydride" state. If there is concurrent hydrogenation of the dienes, then hydrogen will be consumed in that reaction. The optional treatment of the bottoms from the second column (splitter) to cleave the sulfide and produce $H_{2S}$ and diolefins should employ at least a stoichiometric amount of hydrogen and preferably an excess.

Typical of the mercaptan compounds which may be found to a greater or lesser degree in a cracked naphtha are: methyl mercaptan (b.p. 43° F.), ethyl mercaptan (b.p. 99° F.), n-propyl mercaptan (b.p. 154° F.), iso-propyl mercaptan (b.p. 135–140° F.), iso-butyl mercaptan (b.p. 190° F.), tert-butyl mercaptan (b.p. 147° F.), n-butyl mercaptan (b.p. 208° F.), sec-butyl mercaptan (b.p. 203° F.), iso-amyl mercaptan (b.p. 250° F.), n-amyl mercaptan (b.p. 259° F.), a-methylbutyl mercaptan (b.p. 234° F.), a-ethylpropyl mercaptan (b.p. 293° F.), n-hexyl mercaptan (b.p. 304° F.), 2-mercapto hexane (b.p. 284° F.), and 3-mercapto hexane (b.p. 135° F.).

Typical diolefins in the full boiling range naphtha include: butadienes, isoprene (2-methyl butadiene-1,3), cis and trans piperylenes (cis and trans 1,3-pentadienes).

The present invention carries out the method in a catalyst packed column which can be appreciated to contain a vapor phase ascending and some liquid phase as in any distillation. However since the liquid is held up within the column by artificial "flooding", it will be appreciated that there is an increased density over that when the liquid is simply descending because of what would be normal internal reflux.

The distillation column reactor is operated at a pressure such that the reaction mixture is boiling in the bed of catalyst. A "froth level" may be maintained throughout the catalyst bed by control of the bottoms and/or overheads withdrawal rate which improves the effectiveness of the catalyst thereby decreasing the height of catalyst needed. As may be appreciated the liquid is boiling and the physical state is actually a froth having a higher density than would be normal in a packed distillation column but less than the liquid without the boiling vapors.

Referring now to the FIGURE there is depicted a simplified flow diagram of one embodiment of the invention. Cracked naphtha ($C_4$ to $C_7$+) is fed to a stabilizer configured as a distillation column reactor 10 via flow line 2 at a point above the catalyst bed 12. Hydrogen is fed below the bed 12 via flow line 1. The $C_5$ and heavier materials are removed in the upper stripping section 15. The $C_5$ and heavier material, including the mercaptans, are distilled downward into the reaction distillation zone 12 containing the catalytic distillation structure. In the reaction distillation zone 12 substantially all of the mercaptans react with a portion of the diolefins to form higher boiling sulfides which are distilled downward and removed as bottoms via line 8 along with the $C_5$ and heavier material. A rectifying section 16 is provided to insure separation of the sulfides.

The $C_4$ and lighter distillate ($C_4$−), less the mercaptans (except methyl mercaptan), are removed as overheads via flow line 5 and passed through condenser 13 where the condensible materials are condensed. The liquids are collected in accumulator 18 where the gaseous materials, including any unreacted hydrogen, are separated and removed via flow line 3. The unreacted hydrogen may be recycled (not shown) if desired. The liquid distillate product is removed via flow line 9. Some of the liquid is recycled to the column 10 as reflux via line 6. A small thioetherification bed 12 may be placed above the feed line 2 where methyl mercaptan is reacted with diolefins. The resultant thioether will distill out of the column with the other thioethers.

Generally the $C_4$ and lighter material will be used as feed stock for an etherification unit where the isobutylene contained therein will be converted to MTBE and the unreacted normal butenes used in cold acid alkylation. The $C_5$ and heavier materials which contain the sulfides, are fed via line 8 to a second distillation column 20 which acts as a splitter. In this way a $C_6$ or $C_6/C_7$ overheads free of sulfur and diolefins can be recovered without having to handle the entire feed from line 8 in a hydrogenation unit.

Column 20 is operated to carry the $C_5$ and lighter fraction ($C_5$−) overhead via line 25 to condenser 23 where the $C_5$ (and any other condensible such as residual $C_4$'s) are condensed and passed into accumulator 24. The non-condensibles exit via line 27. A portion of the condensed material is returned to column 20 as reflux via line 26 and the remaining portion recovered as a $C_5$ fraction, substantially free of sulfur.

The bottoms 28 are $C_6$+ and contain sulfide compounds. The bottoms 28 may be hydrogenated with hydrogen via line 31 in column 30 which may be operated as a distillation column reactor and using the catalyst previously described as a distillation structure 32. The sulfides are cleaved with the production of $H_2S$ removed via line 34 and diolefins which can be hydrogenated to olefins or alkanes if sufficient hydrogen is present.

The overheads 35 from column 30 may be a $C_6$+ fraction with a portion condensed at 33, accumulated in an accumulator 37 and returned as reflux via line 36 and a stream recovered via line 39. The $C_7$+ is recovered via line 38 as substantially free of sulfur and diolefins. The column could also be operated to take most of the $C_6$+ as bottoms with just a stream taken overhead and returned as reflux to drive the system.

The hydrogenation of the bottoms from the splitter 20 will not require as large a unit as would be required to treat the entire feed from line 8. The hydrogenation unit need not be a distillation column reactor.

EXAMPLE

In this Example a one inch diameter column is loaded with 20 ft of the catalyst as distillation structure in the lower portion of the column. The upper section is left empty. A full boiling range cracked naphtha having the following characteristics is fed to the column.

Mercaptan content, 285 wppm

Diolefin content, ≈0.40 wt %

The conditions and results are shown in TABLE II below.

TABLE II

| | |
|---|---|
| Conditions: | |
| Cracked Naphtha feed rate, lbs/hr | 4 |
| $H_2$ feed rate, SCFH | 1 |
| Overhead pressure, psig | 125 |
| Average catalyst bed temperature, ° F. | 251 |
| Reboiler temperature, ° F. | 400 |
| WHSV | 3 |
| Bottoms rate, lbs/hr | 3.5 |
| Overheads distillate product, lbs/hr | 0.5 |
| Results: | |
| Mercaptan removal | 92% |

The invention claimed is:

1. A process for removing mercaptans from a full boiling range naphtha hydrocarbon stream, comprising the steps of:

(a) feeding a full boiling range naphtha stream containing mercaptans and diolefins to a distillation column reactor above a catalyst bed containing an alumina supported Group VIII metal;

(b) feeding an effectuating amount of hydrogen to said distillation column reactor below the catalyst bed;

(c) concurrently in said distillation column reactor (i) contacting diolefins and mercaptans contained within said naphtha stream in the presence of hydrogen in a distillation reaction zone in the lower section of said distillation column reactor thereby reacting a portion of said mercaptans with a portion of the diolefins to form sulfide products and distillate product and (ii) separating said sulfides from said distillate product by fractional distillation;

(d) withdrawing distillate product from said distillation column reactor at a point above said distillation reaction zone, said distillate product having a reduced mercaptan content; and (e) withdrawing a portion of said naphtha hydrocarbon stream and sulfide products from said distillation column reactor at a point below said distillation reaction zone.

2. The process according to claim 1 wherein said full boiling range naphtha stream is a cracked naphtha distillate containing a $C_4$ and lighter fraction and a $C_5$ and heavier fraction, said $C_4$ and lighter fraction is removed as overheads from said distillation column reactor and said $C_5$ and heavier fraction is removed as bottoms from said distillation column reactor along with said sulfide product.

3. The process according to claim 1 wherein there is a molar excess of diolefins to mercaptans.

4. The process according to claim 3 wherein substantially all of said mercaptans are reacted with diolefins to form sulfide products and said distillate product is substantially mercaptan free.

5. The process according to claim 3 wherein substantially all of said excess of diolefins not reacted with mercaptans are hydrogenated to mono-olefins.

6. The process according to claim 1 wherein said naphtha hydrocarbon stream and sulfide products of step (e) are fractionated to produce a naphtha hydrocarbon fraction free of sulfide products and naphtha hydrocarbon fraction containing said sulfide products.

7. The process according to claim 6 wherein said naphtha hydrocarbon fraction containing said sulfide products is hydrogenated to produce $H_2S$.

8. The process according to claim 1 wherein a second catalyst bed containing an alumina supported Group VIII metal is positioned above said full boiling range naphtha stream wherein methyl mercaptan is contacted with diolefin and reacted to form sulfide products.

9. The process according to claim 1 wherein the hydrogen partial pressure is in the range of 0.1 to 30 psi.

10. The process according to claim 9 wherein the total pressure is 50–200 psig.

11. The process according to claim 10 wherein the temperature in said distillation reaction zone is in the range of 100 to 400° F.

* * * * *